US009657501B2

(12) United States Patent
Armari et al.

(10) Patent No.: US 9,657,501 B2
(45) Date of Patent: May 23, 2017

(54) ELECTRIC STRIKE AND COMBINATION WITH IMPROVED LOCK ASSEMBLY

(75) Inventors: Ernest Armari, New South Wales (AU); Mark Aylesbury, New South Wales (AU)

(73) Assignee: AASA ABLOY AUSTRALIA PTY LTD, Oakleigh, Victoria (AU)

( * ) Notice: Subject to any disclaimer, the term of this patent is extended or adjusted under 35 U.S.C. 154(b) by 1147 days.

(21) Appl. No.: 13/500,519

(22) PCT Filed: Oct. 6, 2010

(86) PCT No.: PCT/AU2010/001305
§ 371 (c)(1),
(2), (4) Date: Nov. 12, 2012

(87) PCT Pub. No.: WO2011/041830
PCT Pub. Date: Apr. 14, 2011

(65) Prior Publication Data

US 2013/0049380 A1 Feb. 28, 2013

(30) Foreign Application Priority Data

Oct. 6, 2009 (AU) ..... 2009904862

(51) Int. Cl.
*E05B 15/02* (2006.01)
*E05B 47/00* (2006.01)
*E05B 15/00* (2006.01)

(52) U.S. Cl.
CPC ..... *E05B 47/0047* (2013.01); *E05B 47/0046* (2013.01); *E05B 2047/0068* (2013.01); *E05B 2047/0073* (2013.01); *E05B 2047/0076* (2013.01); *Y10T 292/0969* (2015.04); *Y10T 292/699* (2015.04)

(58) Field of Classification Search
CPC ..... E05B 47/0046; E05B 47/0047
USPC ..... 292/340, 341.15, 341.16
See application file for complete search history.

(56) References Cited

U.S. PATENT DOCUMENTS 4,211,443 A * 7/1980 Butts ..... E05B 47/0047 292/341.16
4,573,720 A * 3/1986 Nicolai ..... E05B 47/00 292/144
4,904,005 A * 2/1990 Frolov ..... E05B 45/06 292/144

(Continued)

FOREIGN PATENT DOCUMENTS

AU 199187700 11/1993
DE 10361076 B3 * 7/2005 ..... E05B 47/04

(Continued)

OTHER PUBLICATIONS

International Search Report prepared by the Australian Patent Office on Dec. 16, 2010, for International Application No. PCT/AU2010/001305.

*Primary Examiner* — Carlos Lugo
(74) *Attorney, Agent, or Firm* — Sheridan Ross P.C.

(57) ABSTRACT

This invention relates to an improved electric strike assembly (1) including a keeper (6) which is mounted to a housing (8). A locking means including an electrical actuator (9) and a detent (10) configured to resist adjustment of the detent (10) from an active lock condition. The detent (10) is preferably grooved so as to catch on the keeper (6) or housing (8) preventing it moving from an active condition.

13 Claims, 3 Drawing Sheets

(56) References Cited

U.S. PATENT DOCUMENTS

| | | | | |
|---|---|---|---|---|
| 4,984,835 | A * | 1/1991 | Vadacchino et al. | 292/341.16 |
| 5,042,857 | A * | 8/1991 | Burrows et al. | 292/341.16 |
| 5,127,691 | A | 7/1992 | Herron et al. | |
| 5,219,196 | A * | 6/1993 | Luker | 292/341.16 |
| 5,490,698 | A * | 2/1996 | Dezso | E05B 45/06 292/138 |
| 5,690,373 | A * | 11/1997 | Luker | 292/201 |
| 5,735,559 | A * | 4/1998 | Frolov | E05B 47/0047 292/210 |
| 5,934,720 | A * | 8/1999 | Karalius | 292/341.16 |
| 6,299,225 | B1 | 10/2001 | Chang | |
| 6,801,112 | B1 * | 10/2004 | Saxer | H03K 17/965 335/205 |
| 6,874,830 | B2 * | 4/2005 | Bashford | 292/341.16 |
| 7,185,928 | B1 * | 3/2007 | Liao | 292/341.16 |
| 7,322,621 | B2 * | 1/2008 | Liao | 292/341.16 |
| 7,377,560 | B2 * | 5/2008 | Wiemer | E05C 19/16 292/251.5 |
| 7,472,934 | B2 * | 1/2009 | Burke | E05B 47/0047 292/340 |
| 7,540,542 | B2 * | 6/2009 | Geringer et al. | 292/341.16 |
| 8,033,583 | B2 * | 10/2011 | Chang | 292/144 |
| 8,814,233 | B2 * | 8/2014 | Leska | F16P 3/10 292/144 |
| 8,833,814 | B2 * | 9/2014 | Chang | 292/341.16 |
| 2004/0189021 | A1 | 9/2004 | Eckerdt | |
| 2006/0202490 | A1 | 9/2006 | Burke et al. | |
| 2007/0046040 | A1 * | 3/2007 | Chang | 292/341.16 |
| 2010/0116006 | A1 * | 5/2010 | Huang | 70/91 |
| 2010/0127518 | A1 * | 5/2010 | Huang | 292/341.16 |

FOREIGN PATENT DOCUMENTS

| | | | | |
|---|---|---|---|---|
| EP | 1764460 | | 3/2007 | |
| GB | 2134959 | A * | 8/1984 | E05B 47/00 |

* cited by examiner

ELECTRIC STRIKE AND COMBINATION WITH IMPROVED LOCK ASSEMBLY

CROSS REFERENCE TO RELATED APPLICATIONS

This application is a national stage application under 35 U.S.C. 371 of PCT Application No. PCT/AU2010/001305 having an international filing date of 6 Aug. 2010, which designated the United States, which PCT application claimed the benefit of Australian Application No. 2009904862 filed 6 Oct. 2009, the entire disclosure of each of which is incorporated herein by reference.

This application claims priority from Australian Provisional Application No. 2009904862 filed on 6 Oct. 2009, the contents of which are to be taken as incorporated herein by this reference.

This invention relates to an improved electric strike assembly for use with a door. The invention also relates to an improved electric strike assembly in combination with a lock assembly for use with a door. The invention has a particular application in releasably retaining a door panel of the door assembly in a closed position and it will be convenient to hereinafter describe the invention with reference to this application. It ought to be appreciated that the invention may have other applications.

An ordinary strike will generally be mounted on a door jamb and include a keeper that interacts with a latch bolt of a latch assembly mounted on a door panel. In this arrangement the latch bolt must be moved relative to the keeper from its extended position to allow the door panel to move from the closed position. An electric strike differs from an ordinary strike in that with an ordinary strike the keeper is static whereas the keeper of an electric strike is movable relative to its housing. The keeper is moved from its closed position by moving the door panel from the closed position while the latchbolt is in the extended position.

An electric strike also includes a locking means for retaining the keeper in a closed position despite the door panel being urged to move from the closed position. The locking means utilises an electrical actuator that is operable to adjust the condition of a detent that interacts with the keeper. The locking means is often the target for those people trying to circumvent the electric strike. In particular severe and repeated blows to the locking means can result in failure of the locking means to retain the keeper in a closed position.

It is often desirable to remotely monitor the position of the door relative to the door jamb, in particular when the door is required to return to a closed position to maintain security. Previously electrical devices have been attached to the face of the door panel adjacent its movable edge, and the door frame at a complementary position, so as to maintain an electrical circuit when the door is in a closed position. This requires the components of the device to be accurately aligned when fixing them to the panel and jamb. Furthermore the device requires wiring to be run to its power supply and monitoring station.

A reference herein to a patent document or other matter which is given as prior art is not to be taken as an admission that that document or matter was known or that the information it contains was part of the common general knowledge as at the priority date of any of the claims.

According to one aspect of this invention there is an electric strike assembly for use with a door assembly to releasably retain a door panel of the door assembly in a closed position, the electric strike including; a housing, a keeper which in use interacts with a latch bolt associated with the door panel, the keeper being mounted on the housing and being movable relative to the housing from a closed position by moving the door panel with the latch bolt from the closed position, a locking means including a detent that in an active condition interacts with the keeper to obstruct it from moving from the closed position, the locking means including an electrical actuator for adjusting the condition of the detent from the active condition when the keeper is in the closed position, the detent being configured with a surface feature which catches on the keeper when the condition of the detent is being urged to adjust from the active condition and the keeper is being urged to move from the closed position.

It is preferred that the actuator is operable to adjust the condition of the detent by moving the detent in a direction substantially perpendicular to the direction of movement of the keeper. It is further preferred that the locking means is selectively operable in a fail secure condition whereby the detent adopts the active condition in the event of a power supply failure to the electric strike, or in a fail safe condition whereby the detent does not adopt the active condition in the event of a power supply failure to the electric strike. It is preferred that the locking means includes a selector means operable from the outside of the housing for selecting the operation of the locking means as either fail safe or fail secure. The selector means preferably moves the actuator and detent relative to the housing. It is further preferred that the selector means includes at least one fastener securing the actuator to the housing, the housing having at least one aperture through which the fastener extends, the at least one aperture being configured to positively locate the fastener to select fail safe or fail secure. It is further preferred that the at least one aperture is elongate so as to allow the fastener to slide within the aperture when adjusting the selection of the selector means. It is further preferred that the at least one aperture is configured with at least one countersink to positively locate the fastener.

It is preferred that the detent includes at least one pin, said at least one pin is configured with the surface feature on its external surface which catches on the keeper so as to facilitate said resistance to adjusting its condition. The feature on the external surface is preferably an annular grove. It is further preferred that the surface feature is adjacent an end of the pin. It is further preferred that the electric strike include a passageway within which said at least one pin is located, a first portion of the passageway is fixed in position relative to the housing and a second portion is movable with the keeper, the first and second portions of the passageway are aligned when the keeper is in a closed position so as to allow the at least one pin to move relative to the active condition, and the at least one pin catch in the passageway at the surface feature when keeper is urged from the closed position and the detent is in the active condition.

According to another aspect of this invention there is provided an electric strike assembly in combination with a lock assembly for use in monitoring the position of a door panel with respect to its door frame, the electric strike assembly including a housing, a keeper mounted on the housing and being movable relative to the housing from a closed position by moving the door panel with the latch bolt from the closed condition, an electrically controlled lock means that in an active condition obstructs the keeper from moving from the closed position, an electrically operated sensor for sensing a signal, the lock means and the sensor being powered by the same power source, the lock assembly including a housing, a latchbolt which interacts with the keeper and is movable between an extended position and a retracted position through a front face of the housing, a signal generator located proximate the front face of the housing for emitting the signal, whereby the signal emitted by the signal generator is sensed by the sensor when the door is in the closed position.

It is preferred that the sensor includes a switch that adopts a closed position when the signal is sensed. The switch is preferably a reed switch and the signal generator emits a magnetic signal which closes the reed switch when the door is in the closed position. Alternatively the sensor may include a mechanical switch and is moved to a closed position by physical contact with the signal generator. It is preferred that in this alternative that the signal generator is a ball catch including a ball which adopts an extended position when the door is in a closed position causing the switch to adopt the closed position.

It is preferred that the signal generator is located in the housing of the mortice lock assembly, and operates through a front wall of the mortice lock housing. Alternatively the mortice lock assembly includes a face plate attached to a front wall of the mortice lock housing wherein the signal generator is located in the face plate.

It is preferred that the electrically controlled lock means includes a detent that in an active condition interacts with the keeper to obstruct it from moving from the closed position, whereby the electrically controlled lock means is selectively operable in a fail secure condition whereby the detent adopts the active condition in the event of a power supply failure to the electric strike, or in a fail safe condition whereby the detent does not adopt the active condition in the event of a power supply failure to the electric strike. It is further preferred that the lock means of the electric strike include a selector means operable from the outside of the housing for selecting the operation of the lock means as either fail safe or fail secure.

It will be convenient to hereinafter describe in greater detail preferred embodiments of the electric strike assembly and combination with a mortice lock assembly according to the invention with reference to the accompanying drawings. The particularity of the drawings and the related detailed description is not to be understood as superseding the generality of the broad definition of the invention provided by the claims.

Figure 1:
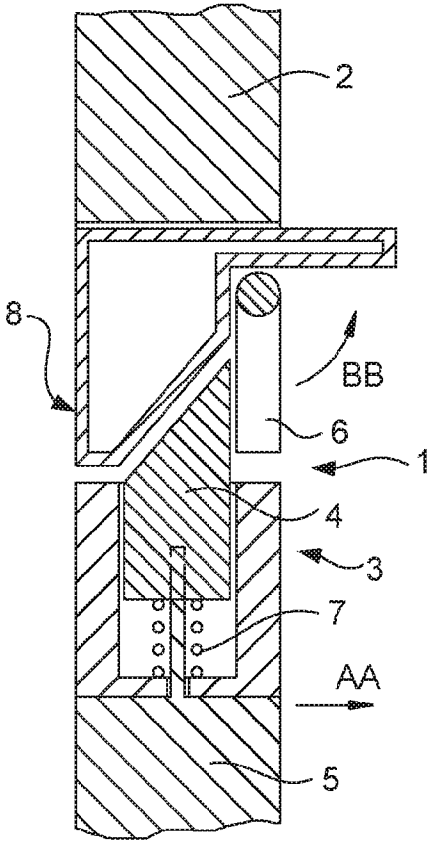
FIG. 1 is a cross-sectional view of an electric strike assembly, in combination with a latch bolt assembly, in a simple diagrammatic form.

FIG. 1 shows in simple diagrammatic form an electric strike assembly 1 mounted to a door frame 2. A latch assembly 3 includes a latch bolt 4 illustrated as mounted to the edge of an adjacent door panel. The electric strike assembly 1 includes a keeper 6 which is shown in FIG. 1 in the closed position relative to its housing 8. When the keeper is held in the closed position it retains the bolt 4, and therefore stops the door panel 5 from being moved relative to the door frame 2 in the direction AA. A handle (not shown) may be included, at least on the outside of the door 5 to facilitate moving the door panel 5 relative to the frame 2. When the keeper 6 is free to move from the closed position, movement of the door panel 5 will cause the keeper to rotate in the direction BB. It ought to be noted however that the handle need not be operably connected to the latch bolt 4, particularly where control of entrance through the door 5 is to be retained by the electric strike assembly 1. Whilst the bolt 4 can be moved to a retracted position while the door is being returned to a closed position, the latch bolt 4 is returned to the extended position as shown by operation of the spring 7.

Figure 2:
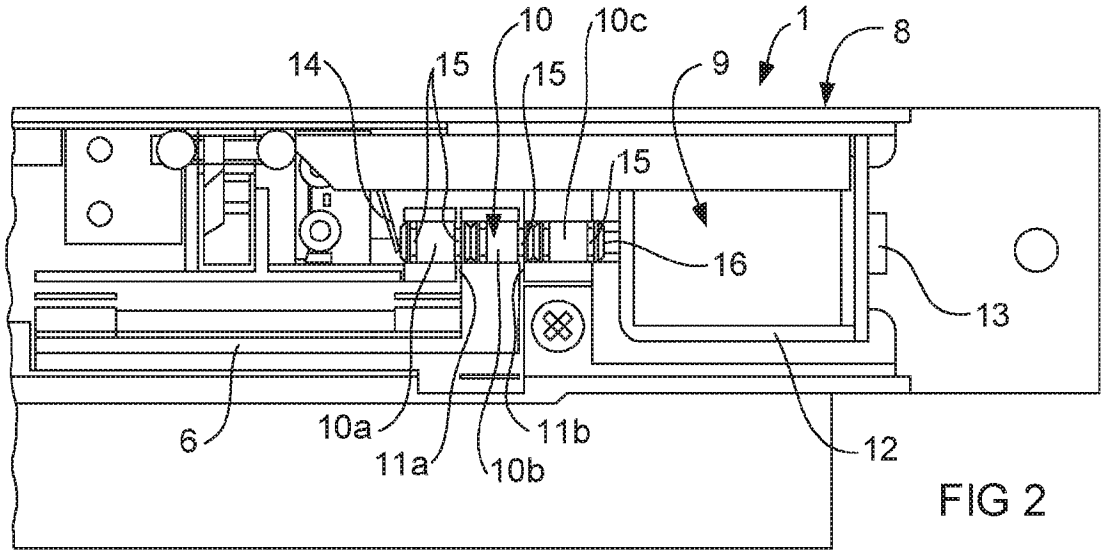
FIG. 2 is a partial front elevation the electric strike assembly with its lock means of in a fail secure condition and the detent in a locked condition interacting with the keeper.

FIG. 2 illustrates in greater detail the inner workings of the electric strike assembly 1, and in order to provide the reader with a reference we note the earlier mentioned features of the housing 8 and the keeper 6. The electric strike assembly includes a locking means which in the embodiment illustrated includes an electrical actuator 9 and a detent 10. The electrical actuator 9 is operable to move the detent 10 relative to the housing 8. FIG. 2 illustrates the detent 10 in an active position whereby it acts as an obstruction to moving of the keeper 6 from the closed position. Any form of detent 10 capable of acting as an obstruction would be acceptable, and in the preferred embodiment illustrated the detent is in the form of three pins 10*a*, 10*b*, 10*c*. The pins slide within bores formed in the keeper 6 and the housing 8. The bore in the keeper 6 is aligned with the bore in the housing 8 when the keeper 6 is in the closed position. The middle 10*b* and left hand pin 10*c* in the illustration extend across sheer lines 11*a*, 11*b* between the housing 8 and the keeper 6 so as to obstruct relative movement between the keeper 6 and the housing 8.

Whilst the illustration shows the keeper is pivotally mounted to the housing, it ought to be appreciated that the electric strike assembly may include a housing and a sub-assembly framing insert to achieve a similar function. Therefore a reference in this specification to the keeper being movable relative to the housing, should also be understood as a reference to the keeper being movable relative to a sub-frame of the housing.

Figure 3:
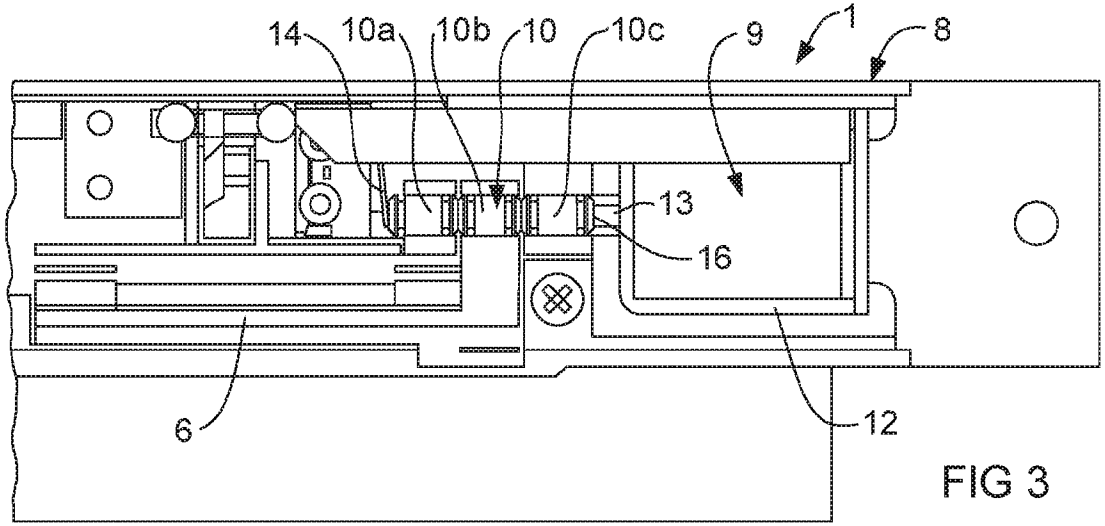
FIG. 3 illustrates the lock means from FIG. 2 in an unlocked condition.

Referring now to FIG. 3 which illustrates the actuator 9 having operated to move the detent 10 to an inactive condition. When the detent 10 is in the inactive condition the sheer lines between each pin 10*a*, 10*b*, 10*c* are aligned with the sheer lines 11*a*, 11*b* between the housing 8 and the keeper 6. When the detent 10 is in this condition, it no longer acts as an obstruction to movement of the keeper 6 from the closed position.

The actuator 9 illustrated in FIGS. 2 and 3 is in the form of a solenoid 12 with a plunger 13 that moves as a result of electrical energy being supplied to the solenoid. The solenoid 12 may include its own biasing means (not shown) for returning the plunger 13 to the position illustrated in FIG. 2. The plunger 13 may be connected to the detent 10 so that extension or retraction of the plunger 13 results in movement of the detent 10 towards and away from the active condition respectively. Alternatively, or in conjunction with this the electric strike assembly 1 may also include a further biasing means for urging movement of the detent 10 against the action of the actuator. The preferred biasing means illustrated may take the form of a micro-switch 14, however other forms of biasing means are clearly possible.

Figure 4:
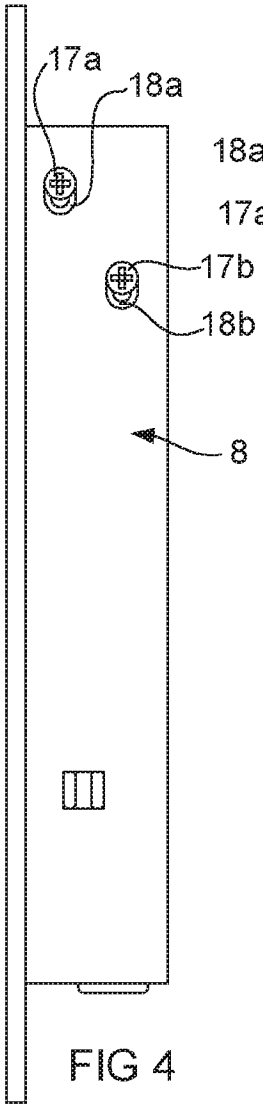
FIG. 4 illustrates a side elevation view of the electric strike assembly with the fasteners shown in an elevated position.
Figure 9:
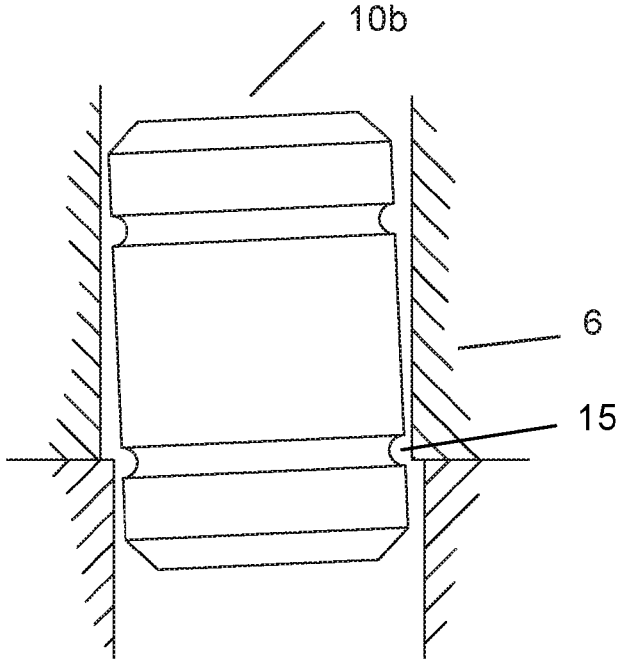
FIG. 9 is an enlarged view of a misaligned pin within the bore of the keeper.

Referring again to FIG. 2 which illustrates a preferred form of the detent according to the invention being configured to resist adjusting its condition when the keeper is being urged from the closed position and the detent is in the active condition. The detent may be configured in any way suitable to achieve this function, and FIG. 4 illustrates a preferred configuration when the preferred form of the detent is the series of pins 10*a*, 10*b*, 10*c*. The pins 10*a*, 10*b*, 10*c* illustrated are cylindrical and are configured with two annular groove features 15 on the external surface thereof adjacent distal ends of each pin 10. FIG. 2 illustrates the groove 15 of the middle pin 10*b* aligned with the sheer line 11*b* between the housing 8 and the keeper 6 and the groove of the left hand pin 10*a* aligned with the sheer line 11*a* between the keeper 6 and the housing 10. When a force is applied to the door 5 to urge the keeper 6 away from the closed position the tolerance between the diameter of the bore within the keeper receiving the pin 10*b*, and the diameter of the pin 10*b* itself results in the pin catching on the keeper 6 in the area of its groove 15. The catching of the pin 10*b* makes it difficult to adjust the condition of the detent 10 from the active condition. More specifically, it is difficult for the pins 10 to move in a direction perpendicular to the direction of movement of the keeper 6 when one or more of the pins is caught at its groove by the keeper 6. When pressure is applied to the door 5 this causes a very small movement of the keeper 6 relative to the house 8. This in turn causes a slight misalignment between the bore in the keeper 6 and the bore in the housing 8 as shown in FIG. 9. A central pin 10*b* responds to this misalignment by slightly pivoting off its axis. This causes the groove 15 in the pin 10*b* to catch on a corner of the keeper 6, thereby inhibiting the ability of the solenoid to move the pins 10.

It ought to be appreciated that the detent 10 could be configured in some other way to resist adjusting its condition when the keeper 6 is urged from the closed position. In particular, when the detent 10 is in the form of one or more pins, the pins may include one or more annular ridges (not shown) which could operate in a manner similar to the annular grooves. Furthermore, the inner surface of the bore in the keeper 6 and housing 8 could be configured with features to interact with features formed on the external surface of each pin. An example of which could be annular grooves in the bore to interact with annular ridges on the pin. Accordingly, other configurations are clearly possible.

Referring now to FIG. 2 or 3 it can be seen that the distal ends of the pins include a bevelled edge 16 (note only the right hand pin is annotated). The bevelled edge 16 assists in accurately aligning the sheer line between the pins 10*a*, 10*b*, 10*c* with the sheer line 11*a*, 11*b* between the housing 18 and the keeper 6. Clearly the ends of each pin 10*a*, 10*b*, 10*c* could be configured with some other formation to achieve the same function.

Referring now to FIG. 4 which shows a side elevation of the electric strike assembly 1 and in particular two fasteners 17*a*, 17*b* adjacent an upper end of the housing 8. The fasteners 17 extend through apertures 18*a*, 18*b* in the housing 8, and secure the position of the actuator 9 (see FIG. 2 or 3) relative to the housing 8. However the position of the fasteners 17 is adjustable relative to the housing 8 to adjust the operation of the locking means. The position of the fasteners illustrated in FIG. 4 corresponds to the locking means operating in a fail secure condition whereby in the event of a power supply failure to the electric strike assembly 1, the locking means will retain the detent 10 in an active condition locking the keeper 6 in a closed position. The locking means illustrated in FIGS. 2, 2 and 4 corresponds to the fail secure condition.

Figure 6:
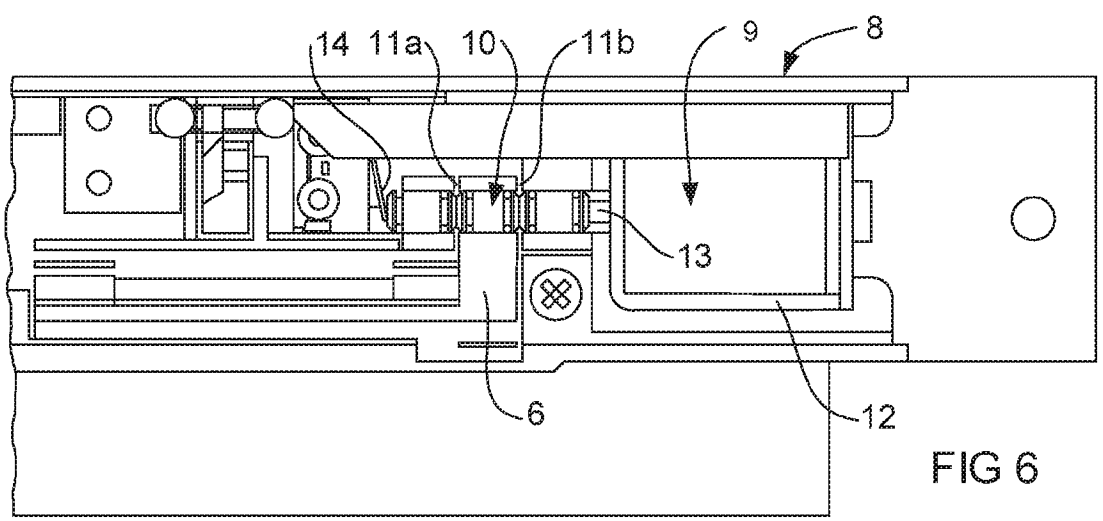
FIG. 6 is a partial front elevation view of the electric strike assembly operating in a fail safe position with the lock means in an unlocked condition.
Figure 5:
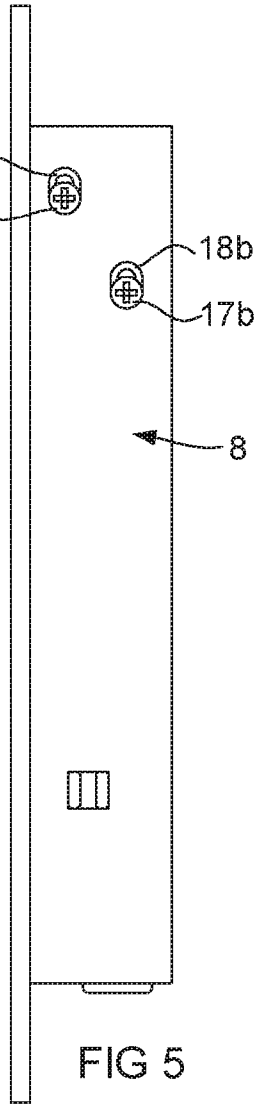
FIG. 5 is a side elevation view of the electric strike assembly with the fasteners shown in a lowered position.

Referring now to FIG. 5 which illustrates the electric strike assembly 1 with the position of the fasteners 17 having been adjusted relative to the apertures 18*a*, 18*b* in the housing 8 to adjust the operation of the locking means. The position of the fasteners 17 has been moved slightly down relative to the position of the fasteners 17 illustrated in FIG. 4. This moves the position of the electrical actuator 9 (see FIG. 2 or 3) down and along with it the detent 10 as can be seen in FIG. 6. The locking means illustrated in FIGS. 2, 5 and 6 correspond to a fail safe condition.

Figure 7:
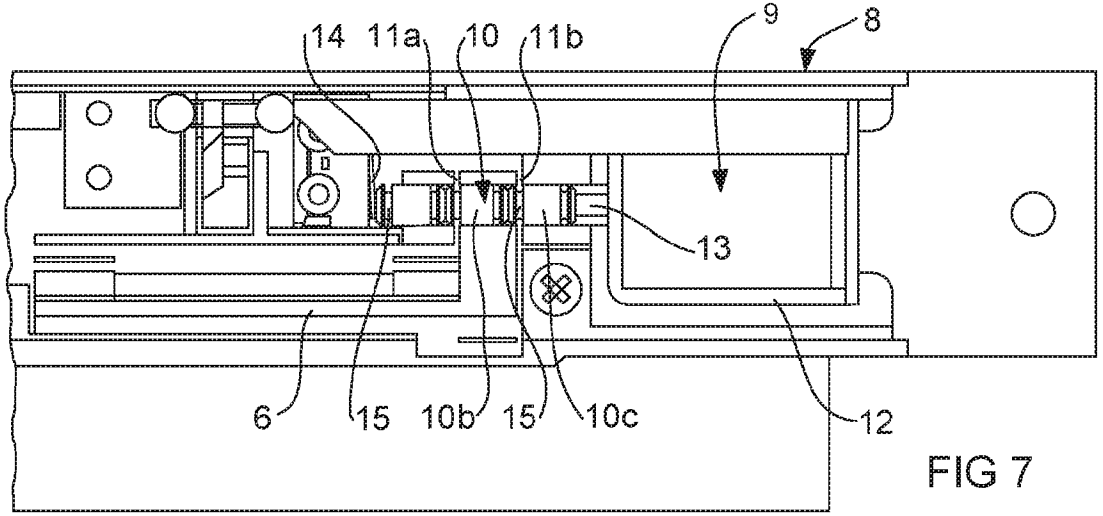
FIG. 7 is the lock assembly from FIG. 6 with the lock means in a locked condition.

FIG. 6 illustrates the locking means where power is not being supplied to the solenoid 12. Furthermore the pins 10 are positioned so that the sheer lines between each pin aligns with the sheer lines 11*a* and 11*b* between the keeper and the housing. When the pins are in this position they fail to obstruct movement of the keeper 6 relative to the housing 8 which allows movement of the door to move the keeper 6 from the closed position. FIG. 7 illustrates the locking means whereby power is supplied to the solenoid 12 to move the pins 10. It should be noted that a groove 15 from the middle pin 10*b* and the right hand pin 10*c* are aligned with the sheer lines 11*a* and 11*b* respectively. Accordingly it should be appreciated that the detent 10 is configured to resist movement from an active condition when a force is applied to the keeper, regardless as to whether the locking means is operating in a fail safe or fail secure condition.

It is a particular advantage of the electric strike assembly 1 of having the fasteners easily accessible from outside the assembly. This allows adjustment of the locking means between fail safe and fail secure without requiring disassembly of the housing 8.

It is preferred that the apertures 18*a*, 18*b*, 18*c* in the housing 8 to accommodate each fastener 17*a*, 17*b* is substantially elongate to allow the fasteners 17 to remain engaged with the electrical actuator 9 while adjusting the position of the actuator 9. In this regard it would be preferable for each fastener 17 to be a captured screw, however this is not essential. Still furthermore, it is preferred that each elongate aperture 18 include a pair of countersinks so as to positively locate each fastener 17 in either position.

Figure 8:
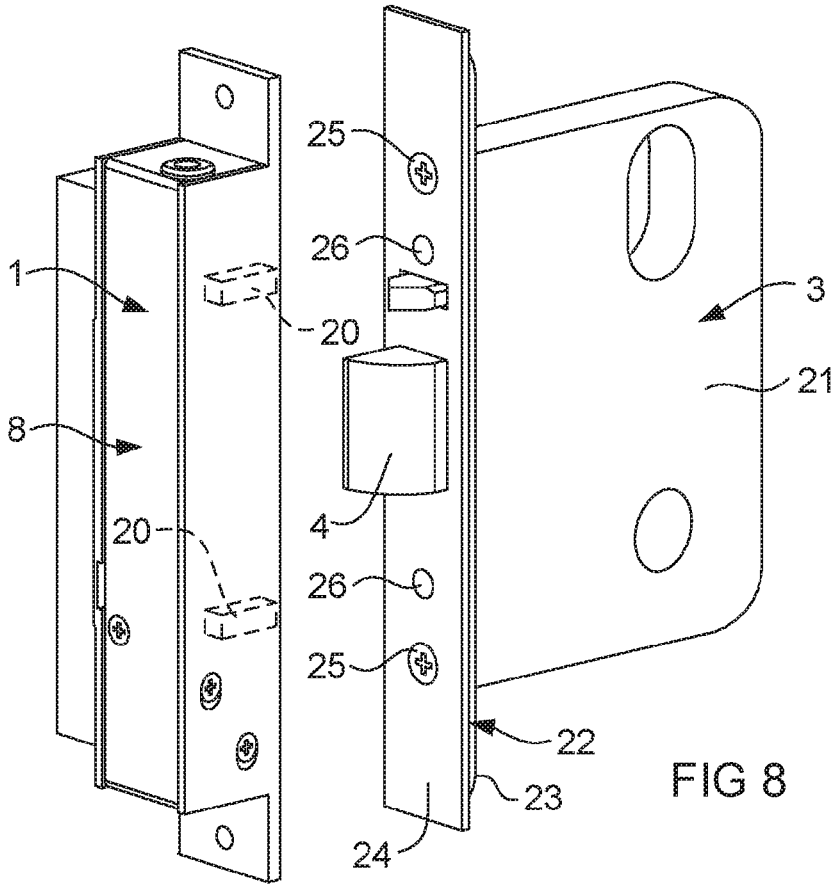
FIG. 8 is an isometric view of an electric strike assembly in combination with a mortice lock assembly.

Referring now to FIG. 8 which illustrates the combination of an electric strike assembly 1 with a mortice lock assembly 3. It ought to be appreciated from the earlier description of FIGS. 2 to 6 that the electric strike assembly 1 will include a housing 8 and a keeper mounted on the housing 8 being movable relative to the housing 8 from a closed position. The electric strike assembly 1 also includes an electrically controlled lock means that controls the movement of the keeper from the closed position. The keeper and lock means are not illustrated in FIG. 8, however their structure and function ought to be appreciated from the description of the previous illustrations.

FIG. 8 illustrates the electric strike assembly 1 including a pair of electrically operated sensors 20. These sensors 20 are to be powered by the same power source as the electrically controlled lock means. The sensors 20 are intended to sense the proximity of an associated lock assembly 3, which in the embodiment illustrates the mortice lock assembly. The mortice lock assembly 3 illustrated includes a housing 21 and a latch bolt 4 that is shown in an extended position extending out through a front face 22 of the housing 21. It ought to be appreciated that the latch bolt 4 can be retracted within the housing 21, however the latch bolt 4 is biased towards an extended position. The housing 21 includes a front wall 23 to which a face plate 24 is attached. The face plate 24 may be attached to the housing 21 by any suitable means, however in the embodiment illustrated it is attached by a pair of fasteners 25.

FIG. 8 illustrates the mortice lock assembly 3 including a pair of signal generators 26 that are aligned with the sensors 20 of the electric strike 1. Each signal generators 26 emit a signal which is received by each sensor 20, particularly when the door is in a closed position. The signal generators 26 illustrated are located on the face plate 24 which is attached to the housing 21. The position of the signal generators 26 is not essential, in that they may alternatively be located on or within the mortice lock housing 21.

The signal generators 26 illustrated in FIG. 8 are in the form of a pair of magnets which emit a magnetic signal which can be received by sensors 20 in the form of reed switches when the door is in a closed position. Other alternatives are clearly possible. Alternatively the sensors 20 may be in the form of a mechanical switch and the signal generator may be in the form of a ball catch or the like. In this alternative arrangement when the door is moved to a closed position the ball of the ball catch would move to an extended position thereby moving the mechanical switch to its closed position.

The number and location of the signal generators 26 and sensors 20 illustrated in FIG. 8 is really preferred, and this may vary according to satisfy requirements of the lock combination.

It should be appreciated from the foregoing description that the present invention provides an improved electric strike assembly that increases the resistance to tampering by unauthorised users. Furthermore the invention provides an improved electric strike and mortice lock assembly combination that enhances the likelihood that the sensors will be aligned with monitoring switches when the electric strike and lock assembly are installed. The monitoring of the sensors can be bundled with the monitoring of the condition of the electric strike and routed to a central control station, which provides a further advantage.

Various alterations and/or additions may be introduced into the electric strike assembly as hereinbefore described without departing from the spirit or ambit of the invention as defined by the claims.

The claims defining the invention are as follows:

1. An electric strike assembly for use with a door assembly to releasably retain a door panel of the door assembly in a closed position, the electric strike including; a housing, a keeper which in use interacts with a latch bolt associated with the door panel, the keeper being mounted on the housing and being movable relative to the housing from a closed position by moving the door panel with the latch bolt from the closed position, a locking means including a detent that in an active condition interacts with the keeper to obstruct the keeper from moving from the closed position and in an inactive condition does not obstruct the keeper from moving from the closed position, the locking means including an electrical actuator for adjusting the condition of the detent from the active condition when the keeper is in the closed position to the inactive condition, the detent including at least one pin, said at least one pin is configured with a surface feature in the form of an annular groove on its external surface which catches on the keeper when the condition of the detent is being urged to adjust away from the active condition and the keeper is being urged to move from the closed position.

2. An electric strike assembly according to claim 1 wherein the actuator is operable to adjust the condition of the detent by moving the detent in a direction substantially perpendicular to the direction of movement of the keeper.

3. An electric strike according to claim 1 wherein the locking means is selectively operable in a fail secure condition whereby the detent adopts the active condition in the event of a power supply failure to the electric strike, or in a fail safe condition whereby the detent does not adopt the active condition in the event of a power supply failure to the electric strike.

4. An electric strike according to claim 3 wherein the locking means includes a selector means operable from the outside of the housing for selecting the operation of the locking means as either fail safe or fail secure.

5. An electric strike according to claim 4 wherein adjustment of the selector means moves the actuator and detent relative to the housing.

6. An electric strike according to claim 5 wherein the selector means includes at least one fastener securing the actuator to the housing, the housing having at least one aperture through which the fastener extends, the at least one aperture being configured to positively locate the fastener to select fail safe or fail secure.

7. An electric strike according to claim 6 wherein said at least one aperture is elongate so as to allow the fastener to slide within the aperture when adjusting the selection of the selector means.

8. An electric strike according to claim 7 wherein said at least one aperture is configured with at least one countersink to positively locate the fastener.

9. An electric strike according to claim 1 wherein the feature on the external surface is adjacent an end of the pin.

10. An electric strike according to claim 9 including a passageway within which said at least one pin is located, a first portion of the passageway is fixed in position relative to the housing and a second portion is movable with the keeper, the first and second portions of the passageway are aligned when the keeper is in a closed position so as to allow the at least one pin to move relative to the active condition, and the at least one pin catch in the passageway at the surface feature when keeper is urged from the closed position and the detent is in the active condition.

11. An electric strike assembly according to claim 1, in combination with a lock assembly for use in monitoring the position of a door panel with respect to its door frame, the electric strike assembly including a housing, a keeper mounted on the housing and being movable relative to the housing from a closed position by moving the door panel with the latch bolt from the closed condition, an electrically controlled lock means that in an active condition obstructs the keeper from moving from the closed position and in an inactive condition does not obstruct the keeper from moving, an electrically operated sensor for sensing a signal, the lock means and the sensor being powered by the same power source, the lock assembly including a housing, a latchbolt which interacts with the keeper and is movable between an extended position and a retracted position through a front face of the housing, a signal generator located proximate the front face of the housing for emitting the signal, whereby the signal emitted by the signal generator is sensed by the sensor when the door is in the closed position.

12. A combination according to claim 11 wherein the electrically controlled lock means includes a detent that in an active condition interacts with the keeper to obstruct it from moving from the closed position, whereby the electrically controlled lock means is selectively operable in a fail secure condition whereby the detent adopts the active condition in the event of a power supply failure to the electric strike, or in a fail safe condition whereby the detent does not adopt the active condition in the event of a power supply failure to the electric strike.

13. An electric strike according to claim 11 wherein the lock means includes a selector means operable from the outside of the housing for selecting the operation of the lock means as either fail safe or fail secure.

* * * * *